US007150509B2

(12) United States Patent
Chen et al.

(10) Patent No.: US 7,150,509 B2
(45) Date of Patent: Dec. 19, 2006

(54) SAFE GUARD FOR A MULTI-SECTION SLIDE TRACK ASSEMBLY OF DRAWERS

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 18 days.

(21) Appl. No.: 10/778,219

(22) Filed: Feb. 17, 2004

(65) Prior Publication Data

US 2005/0179350 A1 Aug. 18, 2005

(51) Int. Cl.
*A47B 88/00* (2006.01)

(52) U.S. Cl. ..... 312/334.47; 312/334.44; 312/333

(58) Field of Classification Search ..... 312/332.1, 312/333, 334.44, 334.46, 334.47; 384/21
See application file for complete search history.

(56) References Cited

U.S. PATENT DOCUMENTS

| | | | | | |
|---|---|---|---|---|---|
| 4,998,828 | A * | 3/1991 | Hobbs | ..... | 312/334.46 |
| 5,551,775 | A * | 9/1996 | Parvin | ..... | 312/334.11 |
| 5,851,059 | A * | 12/1998 | Cirocco | ..... | 312/334.11 |
| 6,224,177 | B1 * | 5/2001 | Chu | ..... | 312/333 |
| 6,254,205 | B1 * | 7/2001 | Wright et al. | ..... | 312/217 |
| 6,367,899 | B1 * | 4/2002 | Hwang et al. | ..... | 312/334.47 |
| 6,390,574 | B1 * | 5/2002 | Fraccaro | ..... | 312/333 |
| 6,705,689 | B1 * | 3/2004 | Chen et al. | ..... | 312/334.46 |
| 6,749,276 | B1 * | 6/2004 | Judge et al. | ..... | 312/334.47 |
| 6,789,862 | B1 * | 9/2004 | Shih-Long et al. | .... | 312/334.46 |
| 6,851,773 | B1 * | 2/2005 | Chen et al. | ..... | 312/334.46 |
| 6,860,575 | B1 * | 3/2005 | Chen et al. | ..... | 312/334.46 |
| 7,008,030 | B1 * | 3/2006 | Yang | ..... | 312/334.46 |
| 2004/0174100 | A1 * | 9/2004 | Chen et al. | ..... | 312/333 |

FOREIGN PATENT DOCUMENTS

| | | | | |
|---|---|---|---|---|
| JP | 03165712 | * | 7/1991 | ..... 312/334.46 |

* cited by examiner

*Primary Examiner*—Lanna Mai
*Assistant Examiner*—Hanh V. Tran
(74) *Attorney, Agent, or Firm*—Birch, Stewart, Kolasch & Birch, LLP

(57) ABSTRACT

A safe guard device for the multi-section slide track assembly of drawers includes an inner slide track, an intermediate slide track, a limit member mounted on the intermediate slide track and an outer slide track. The inner slide track and the intermediate slide track are nested in the outer slide track and the limit member is used to engage and to position an end of the inner slide track. The limit member is able to pivot with respect to the intermediate slide track for engaging with or disengaging from the inner slide track. In retracing operation, the engagement of the inner slide track with the limit member provides with a temporary space on the inner slide track for accommodating fingers of an operator.

1 Claim, 7 Drawing Sheets

SAFE GUARD FOR A MULTI-SECTION SLIDE TRACK ASSEMBLY OF DRAWERS

BACKGROUND OF THE INVENTION

1. Field of the Invention

The present invention relates to a safe guard device for a multi-section slide track assembly of drawers. More particularly, the present invention relates to a limit member mounted on an intermediate slide track so as to retain an inner slide track in retracting movement that will not damage fingers of an operator.

2. Description of the Related Art

Referring to FIG. 8, a conventional three-section slide track for a drawer includes an inner slide track (A), an intermediate slide track (B) and an outer slide track (C). The inner slide track (A) and the intermediate slide track (B) are nested in the outer slide track (C). A pair of ball tracks (D) and (E) are sandwiched in between any two of the inner slide track (A), the intermediate slide track (B) and the outer slide track (C) so as to smoothen slide movement. Moreover, the inner slide track (A) and the intermediate slide track (B) mount a retaining member (F) and a stop member (G) respectively for retaining in one-way direction while relatively extending them. The inner slide track (A) includes a narrowed portion (A1) at its rear end and a bent portion (A2) at its front end. Correspondingly, the outer slide track (C) includes an elastic barrier (H) at its rear end for engaging with the narrowed portion (A1) of the inner slide track (A).

Further, the retaining member (F) is attached to an inner surface of the inner slide track (A), and provided with an engaging portion (F1). The stop member (G) is mounted to a front end of the intermediate slide track (B), and formed with a protrusion (G1). Users can draw out a keyboard or a component, which is attached to the inner slide track (A), for servicing. To prevent taking apart them by accident, the protrusion (G1) of the stop member (G) is engaged with the engaging portion (F1) of the retaining member (F) in place when user draws out the inner slide track (A) from the intermediate slide track (B). Alternatively, when user retracts the inner slide track (A), the bent portion (A2) of the inner slide track (A) initially pushes the stop member (G) of the intermediate slide track (B) that causes a slide movement of the intermediate slide track (B) with respect to the outer slide track (C). Subsequently, the narrowed portion (A1) of the inner slide track (A) may be securely engaged with the elastic barrier (H) of the outer slide track (C) after retracting a predetermined distance of the inner slide track (A). Consequently, the bent portion (A2) of the inner slide track (A) is in contact with the stop member (G) of the intermediate slide track (B) and inserted into a front end of the outer slide track (C).

On the one hand the engagement of the retaining member (F) with the stop member (G) eliminates a careless release of the inner slide track (A) while drawing out it; and on the other hand the engagement of the narrowed portion (A1) with the elastic barrier (H) carries out a secure position of the inner slide track (A) after retracting it. However, fingers held on the inner slide track (A) is easily run into the slide track before the bent portion (A2) is in contact with the stop member (G) or inserted into the front end of the outer slide track (C). As a result, the fingers will be damaged if the return movement of the inner slide track (A) is too fast or user has no attention to release the inner slide track (A) in time.

The present invention intends to provide a safe guard device for a multi-section slide track assembly of drawers.

The safe guard device includes a limit member mounted on the multi-section slide track assembly in such a way to mitigate and overcome the above problem.

SUMMARY OF THE INVENTION

The primary objective of this invention is to provide a safe guard device for a multi-section slide track assembly of drawers, which includes a limit member mounted on an intermediate slide track to temporarily position an inner slide track on the intermediate slide track. Thereby, an end of the inner slide track engages with the limit member that provides with a temporary space for accommodating fingers of an operator.

The secondary objective of this invention is to provide a safe guard device for a multi-section slide track assembly of drawers, which includes a limit member mounted on an intermediate slide track to temporarily position an inner slide track. Thereby, the entire structure of the multi-section slide track assembly is simplified.

The safe guard device for the multi-section slide track assembly of drawers in accordance with the present invention includes an inner slide track, an intermediate slide track, a limit member mounted on the intermediate slide track and an outer slide track. The inner slide track and the intermediate slide track are nested in the outer slide track and the limit member is used to engage and to position an end of the inner slide track. The limit member is able to pivot with respect to the intermediate slide track for engaging with or disengaging from the inner slide track. In retracing operation, the engagement of the inner slide track with the limit member provides with a temporary space on the inner slide track for accommodating fingers of an operator.

In design choice, the safe guard device in accordance with the present invention consists of an elastic thin lug, a guiding flange and at least one engaging hole. The elastic thin lug is provided with a bias force on the intermediate slide track and received in a slot of the intermediate slide track. The guiding flange is extended from the side edge of the limit member to engage with a press plate of the outer slide track for pivotal movement of the limit member. The engaging hole is corresponding to a protrusion of the intermediate slide track that ranges the movement of the engaging hole.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings wherein.

DETAILED DESCRIPTION OF THE INVENTION

Figure 1:
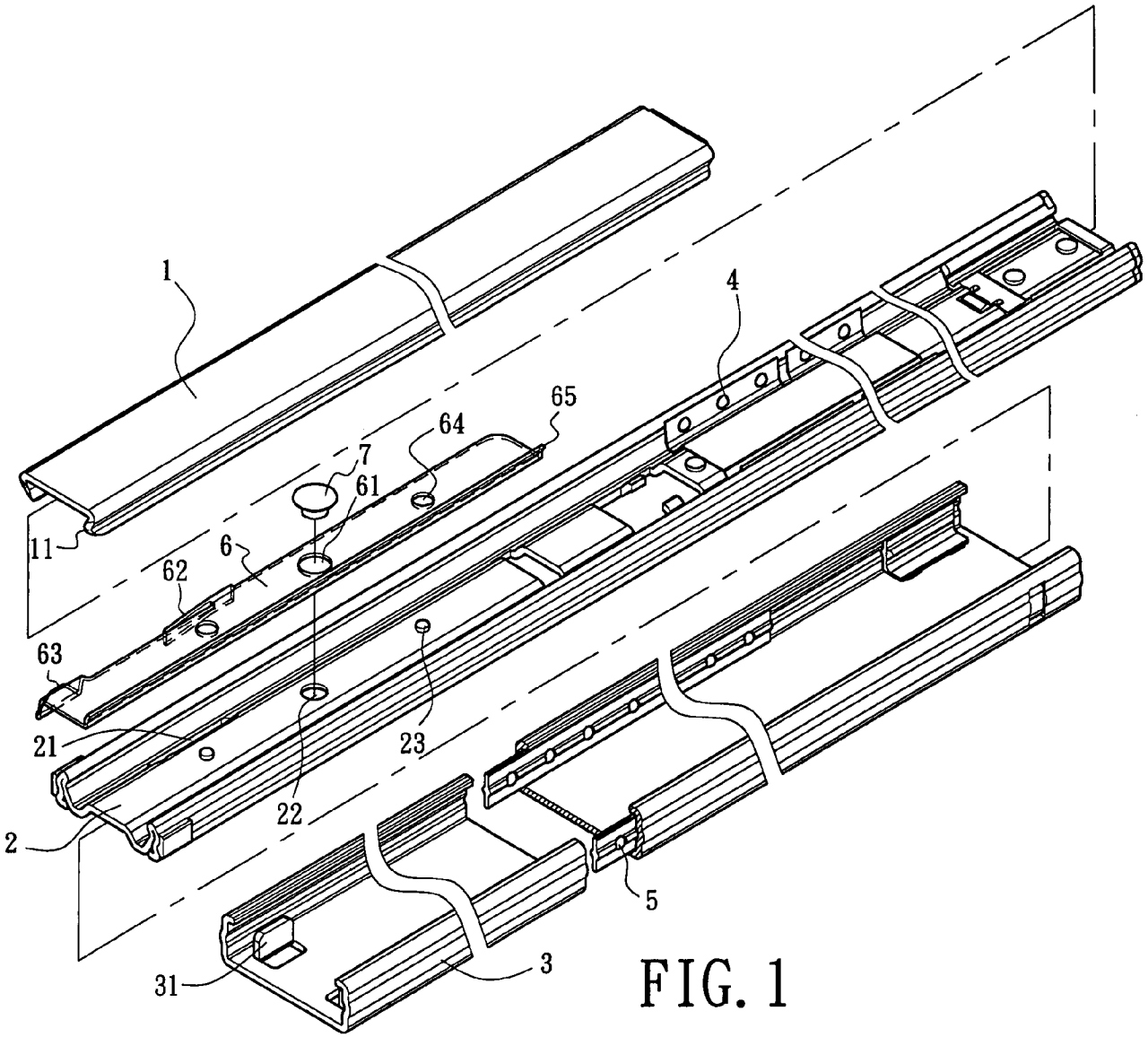
FIG. 1 is an exploded perspective view of a three-section slide track assembly of drawers in accordance with a preferred embodiment of the present invention.
Figure 2:
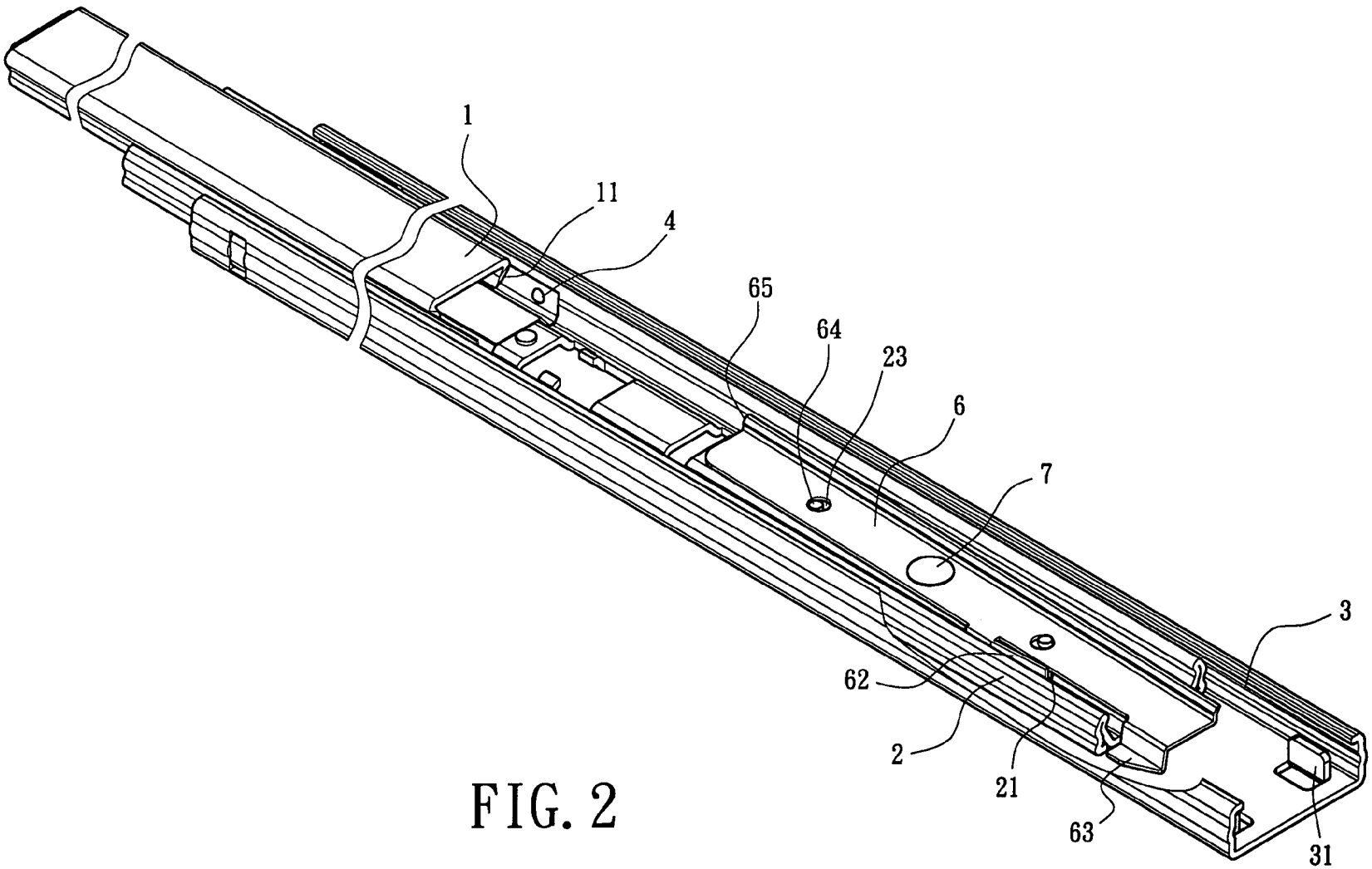
FIG. 2 is an assembled perspective view of the three-section slide track assembly of the drawers in accordance with the preferred embodiment of the present invention.

Referring to FIGS. 1 and 2, it depicts that a three-section slide track assembly of drawers has a safe guard device. The three-section slide track assembly of drawers in accordance with a preferred embodiment of the present invention comprises an inner slide track 1, an intermediate slide track 2 and an outer slide track 3, each of which has a conventional configuration. The inner slide track 1, the intermediate slide track 2 and the outer slide track 3 are rigid and strong to withstand normal use. In retracting operation, the inner slide track 1 and the intermediate slide track are nested in the outer slide track 3.

To reduce the running abrasion in use, a pair of ball tracks 4 and 5 are sandwiched in between any two of the inner slide track 1, the intermediate slide track 2 and the outer slide track 3 so as to smoothen slide movement. However, the entire structure is designed to have as low a friction characteristic as possible. In extending operation, the inner slide track 1 is able to extend a predetermined distance in longitudinal direction with respect to the intermediate slide track 2. Similarly, the intermediate slide track 2 is able to extend a predetermined distance in longitudinal direction with respect to the outer slide track 3. To avoid a careless release of the inner slide track 1, a conventional retaining member is provided on the inner slide track 1.

Although only the retaining construction of the inner slide track 1 has been discussed, it will be appreciated that the inner slide track 1 includes known structures such as a retaining member, a stop member and the like etc.

Referring again to FIGS. 1 and 2, the intermediate slide track 2 includes a limit member 6 mounted thereon in proper, thereby constituting the safe guard device. Construction of the limit member 6 shall be described in detail.

The limit member 6 employs an elongated piece provided with a bent flange (not labeled) on a first side edge. The limit member 6 further consists of an assembling hole 61, an elastic thin lug 62, a guiding inclined flange 63, at least one engaging hole 64 and an engaging distal end 65. Preferably, the assembling hole 61 is formed on a medium section of the limit member 6 and adapted to receive a positioning member 7 for mounting on the end of the intermediate slide track 2 and allowing pivotal movement with respect to the intermediate slide track 2. Correspondingly, the intermediate slide track 2 includes an assembling hole 22 aligned with the assembling hole 61 of the limit member 6 and also adapted to receive the positioning member 7 when assembled with the limit member 6. Further preferably, the elastic thin lug 62 is integrally formed on a second side edge of the limit member 6 and provided with a bias force on the intermediate slide track 2. Correspondingly, the intermediate slide track 2 includes a slot 21 to receive the elastic thin lug 62 of the limit member 6 when assembled. In design choice, it will be appreciated that the elastic thin lug 62 can be substituted by a spring. Next, the guiding flange 63 is extended and protruded from the side edge of the limit member 6. Correspondingly, the outer slide track 3 includes a press plate 31 at its end to engage with the guiding flange 63 of the limit member 6 in retracting operation. Next, the limit member 6 preferably includes a pair of the engaging holes 64 at either side of the assembling hole 61. Correspondingly, the intermediate slide track 2 preferably includes a pair of protrusions 23 to range the movement of the engaging holes 64 of the limit member 6.

Figure 3:
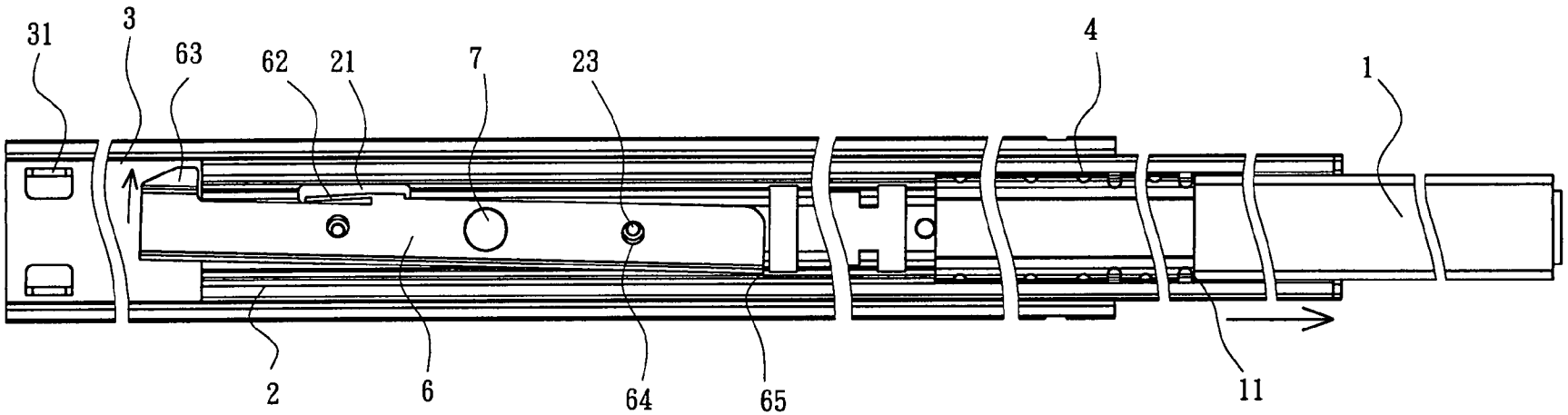
FIG. 3 is a lateral view of the three-section slide track assembly of the drawers in accordance with the preferred embodiment of the present invention in extending operation.

Turning now to FIG. 3, it depicts that the three-section slide track assembly is extended. Extending operation of the three-section slide track assembly shall be described in detail.

When the inner slide track 1 is drawn out from the intermediate slide track 2 and the outer slide track 3, the guiding flange 63 of the limit member 6 is disengaged from the press plate 31 of the outer slide track 3. Thus, the elastic thin lug 62 automatically biases the limit member 6 to rotate a slightly angular movement. Consequently, the engaging distal end 65 of the limit member 6 abuts against a side edge of the intermediate slide track 2 to thereby confine the relatively retracting movement of the inner slide track 1.

Figure 4:
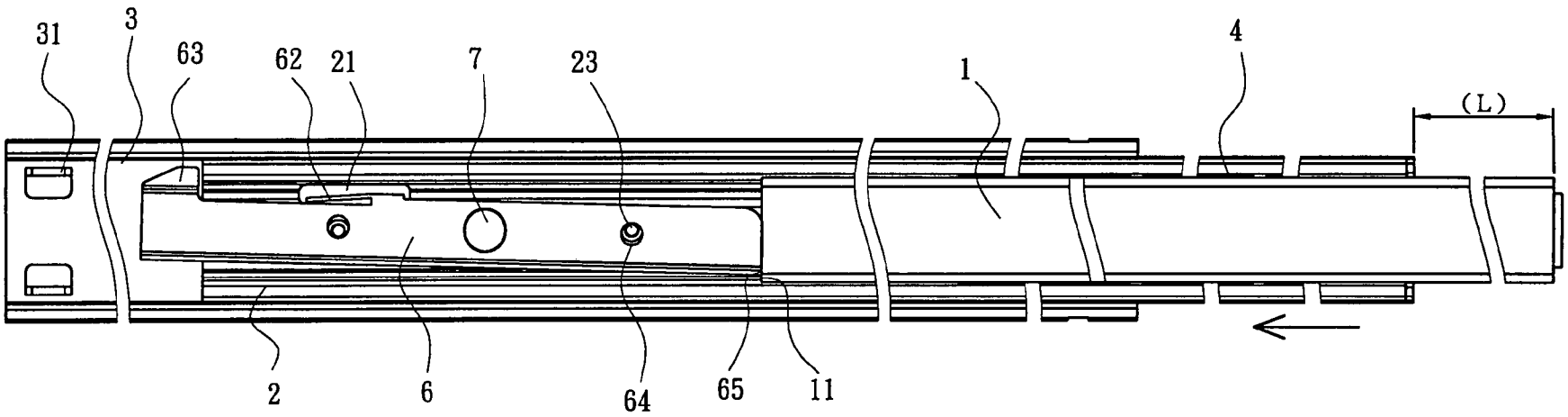
FIG. 4 is a lateral view of the three-section slide track assembly of the drawers in accordance with the preferred embodiment of the present invention in a first step of retracting operation.

Turning now to FIG. 4, it depicts that the three-section slide track assembly is retracted in the first step. Retracting operation of the inner slide track 1 shall be described in detail.

When the inner slide track 1 is initially inserted a predetermined distance into the intermediate slide track 2, an end of the inner slide track 1 is engaged with the engaging distal end 65 of the limit member 6 and thus temporarily positioned on the intermediate slide track 2. Consequently, the other end of the inner slide track 1 provides with a temporary space with a specific length (L) for accommodating fingers of an operator. In other words, the retraction of the inner slide track 1 into the intermediate slide track 2 has not completed yet. Once the inner slide track 1 is engaged with the limit member 6, it alerts the operator to release his fingers from the inner slide track 1.

Figure 5:
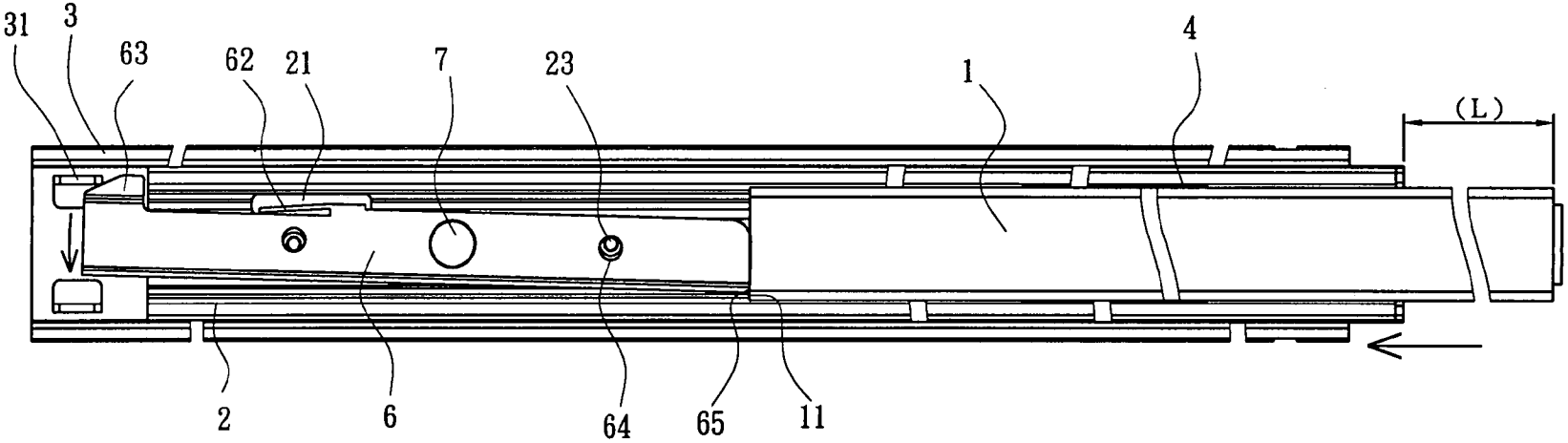
FIG. 5 is a lateral view, similar to that shown in FIG. 4, of the three-section slide track assembly of the drawers in accordance with the preferred embodiment of the present invention in a second step of retracting operation.

Turning now to FIG. 5, it depicts that the three-section slide track assembly is retracted in the second step. Retracting operation of the inner slide track 1 and the intermediate slide track 2 shall be described in detail.

Subsequently, the combination of the inner slide track 1 and the intermediate slide track 2 is successively pushed into the outer slide track 3. Before the combination of the inner slide track 1 and the intermediate slide track 2 is retracted into the outer slide track 3, the guiding flange 63 of the limit member 6 is engaged with the press plate 31 of the outer slide track 3 for unlocking of it. As a result, the operator must further act an additional force to push the inner slide track 1 that carries out the disengagement of the inner slide track 1 from the limit member 6 for retracting operation. At this time, the operator must prepare releasing his fingers from the inner slide track 1 for safety purpose.

Figure 6:
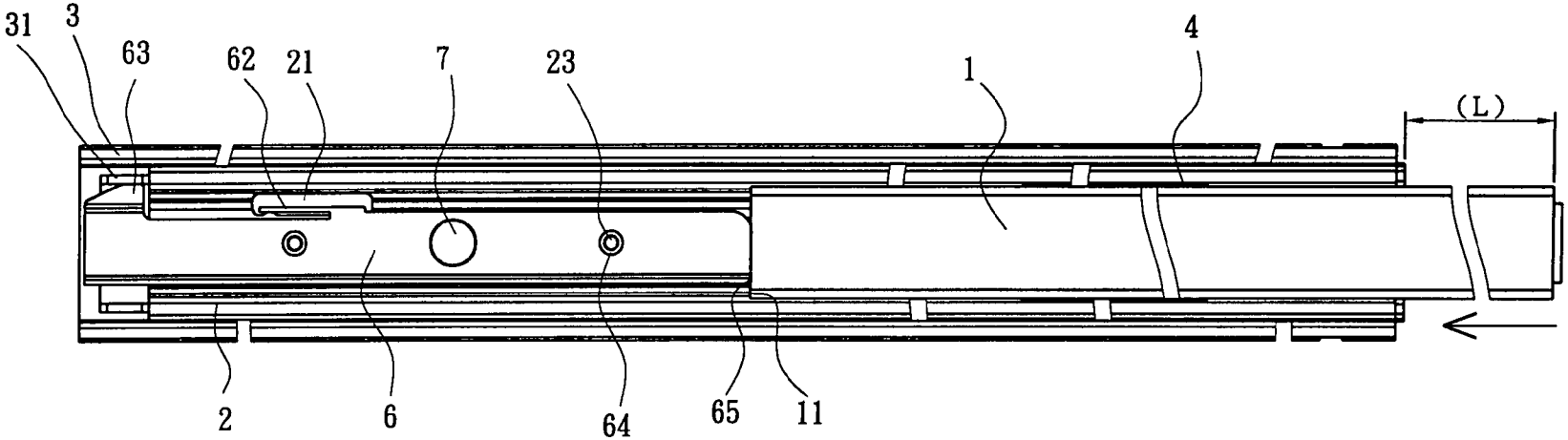
FIG. 6 is a lateral view, similar to that shown in FIG. 4, of the three-section slide track assembly of the drawers in accordance with the preferred embodiment of the present invention in a third step of retracting operation.

Turning now to FIG. 6, it depicts that the three-section slide track assembly is retracted in the third step. Retracting operation of the inner slide track 1 and the intermediate slide track 2 shall be described in detail.

Subsequently, the combination of the inner slide track 1 and the intermediate slide track 2 is successively pushed into the outer slide track 3. Once the press plate 31 of the outer slide track 3 has pressed and passed through the guiding flange 63 of the limit member 6, the limit member 6 automatically releases the inner slide track 1 and allows it to retract into the intermediate slide track 2.

Figure 7:
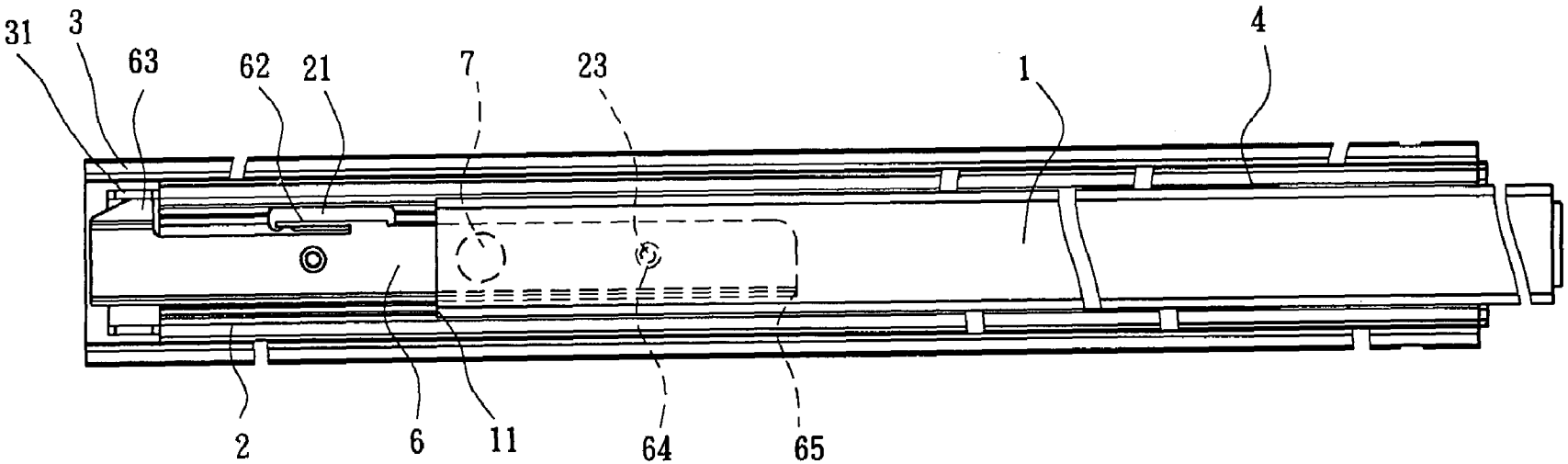
FIG. 7 is a lateral view, similar to that shown in FIG. 4, of the three-section slide track assembly of the drawers in accordance with the preferred embodiment of the present invention in a fourth step of finally retracting operation.
Figure 8:
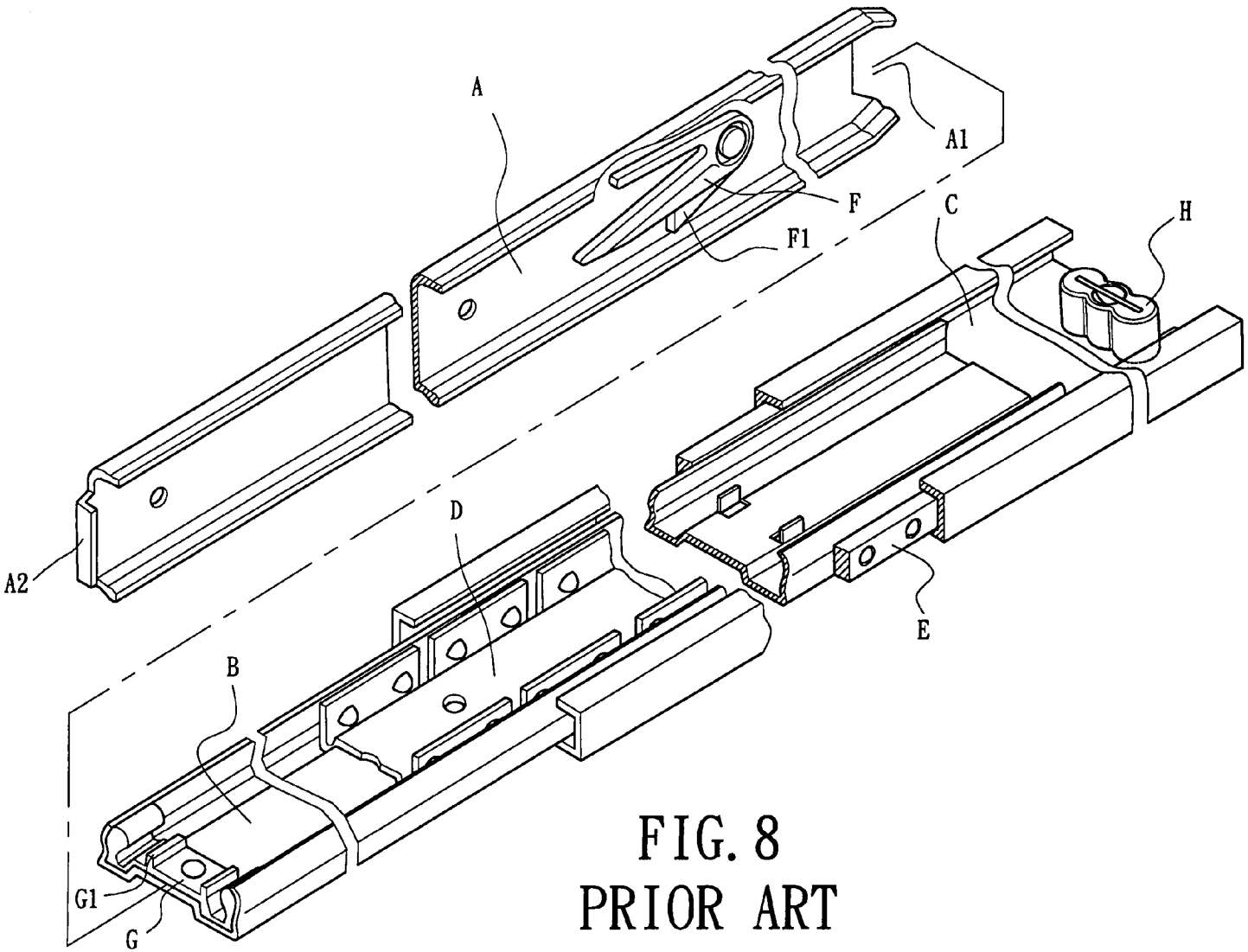
FIG. 8 PRIOR ART
FIG. 8 is an exploded perspective view of a conventional three-section slide track in accordance with the prior art.

Turning now to FIG. 7, it depicts that the three-section slide track assembly is completely retracted in the fourth step. Finally retracting operation of the inner slide track 1 and the intermediate slide track 2 shall be described in detail.

Finally, once the limit member 6 releases the inner slide track 1, the operator can carefully push the inner slide track 1 and the intermediate slide track 2 into the outer slide track 3 without damaging the fingers. The remained length (L) of the inner slide track 1, as shown in FIGS. 4 through 6, is retracted into the intermediate slide track 2. Consequently, the inner slide track 1 and the intermediate slide track 2 are nested in the outer slide track 3 and the three-section slide track assembly is completely retracted.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A safe guard device for a multi-section slide track assembly, comprising:

an inner slide track including a first end and a second end;

an intermediate slide track adapted to receive the inner slide track;

a limit member mounted to the intermediate slide track and actuated by a bias force for pivotal movement, the limit member including a distal end to engage with the first end of the inner slide track to provide a temporary space formed between an end of the intermediate slide track and the second end of the inner slide track for accommodating fingers of an operator holding on the second end of the inner slide track, and the limit member further including a guiding flange to cause the pivotal movement of the limit member, said limit member further comprising a pair of engaging holes at either side of an assembling hole of the limit member, and the intermediate slide track correspondingly includes a pair of protrusions to be received in the engaging holes of the limit member such that a range of the pivotal movement of the limit member being confined; and an outer slide track including a press plate to engage with the guiding flange of the limit member so as to unlock the engagement of the first end of the inner slide track with the distal end of the limit member;

wherein when the inner slide track is initially retracted to a predetermined position into the intermediate slide track, the first end of the inner slide track is engaged with the distal end of the limit member to provide the temporary space formed between the end of the intermediate slide track and the second end of the inner slide track to avoid catching the fingers, and a combination of the inner slide track and the intermediate slide track is formed;

wherein when the combination of inner slide track and the intermediate slide track is further retracted into the outer slide track, the press plate of the outer slide track presses the guiding flange of the limit member to cause the pivotal movement so that the engagement of the first end of the inner slide track with the distal end of the limit member is unlocked, thereby permitting the inner slide track to retract into the intermediate slide track.

* * * * *